US006302131B1

(12) United States Patent
Pitsch

(10) Patent No.: US 6,302,131 B1
(45) Date of Patent: Oct. 16, 2001

(54) SYSTEM AND METHOD OF PLUMBING INSTALLATION

(75) Inventor: Walter Pitsch, Franklin Park, NJ (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/543,811

(22) Filed: Apr. 6, 2000

(51) Int. Cl.[7] ..... F16K 27/00
(52) U.S. Cl. ..... 137/15.18; 137/269
(58) Field of Search ..... 137/454.2, 454.5, 137/269, 270, 271, 15.18

(56) References Cited

U.S. PATENT DOCUMENTS 4,930,538 * 6/1990 Browne ..... 137/269
5,402,827 * 4/1995 Gonzalez ..... 137/271 X
5,524,668 * 6/1996 Matsuo et al. ..... 137/454.2 X
5,730,184 * 3/1998 Monch ..... 137/269 X

* cited by examiner

*Primary Examiner*—Kevin Lee

(57) ABSTRACT

In one preferred embodiment, the present invention relates to a system which includes at least one housing body of a given depth, a mounting flange of a given depth, and at least one cartridge of a given depth. The system may further preferably include trim having dimensions concordant with the common underbody system defined by the housing body, flange and cartridge. A common roughing in depth for the fitting is achieved by the present invention.

2 Claims, 2 Drawing Sheets

SYSTEM AND METHOD OF PLUMBING INSTALLATION

FIELD OF THE INVENTION

The present invention relates to the installation of plumbing fittings, generally and, more particularly, but not by way of limitation, to a novel system and method of installing bath and shower plumbing fittings.

BACKGROUND OF THE INVENTION

Numerous difficulties arise in installing plumbing fittings, in both residential and commercial settings, where the sizes and shapes and configurations of various components needed to complete a plumbing connection are not standardized. Such problems are described in U.S. Pat. No. 3,376,888 and U.S. Pat. No. 4,842,009, both of which are incorporated herein in their entirety.

Two types of valve arrangements are found in the industry, for example a cycling valve which allows volume control as shown for example in U.S. Pat. No. 5,562,120 which is incorporated herein in its entirety, and a lever actuated valve which allows both temperature and temperature control of a mixed flow, as illustrated for example in U.S. Pat. No. 5,794,650 which is incorporated herein in its entirety.

One object of the present invention is to provide a system and method for installing plumbing fittings which offers interchangeability of components and increased flexibility.

Another object of the present invention is to provide a system and method for installing plumbing fittings which facilitates upgradability.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing the following.

In one aspect, the present invention relates to a plumbing installation system comprising at least one housing body, a first cartridge which is removably attachable to the housing body, a second cartridge which is removably attachable to the housing body, wherein the first and second cartridges are functionally dissimilar, and wherein the first and second cartridges are of substantially similar depth.

In yet another aspect, the present invention relates to a method of installing plumbing fittings comprising providing at least one housing body, providing a first cartridge which is removably attachable to the housing body, providing a second cartridge which is removably attachable to the housing body, wherein the first and second cartridges are functionally dissimilar; and wherein the first and second cartridges are of substantially similar depth, and installing one of the cartridges onto s the aid housing body.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
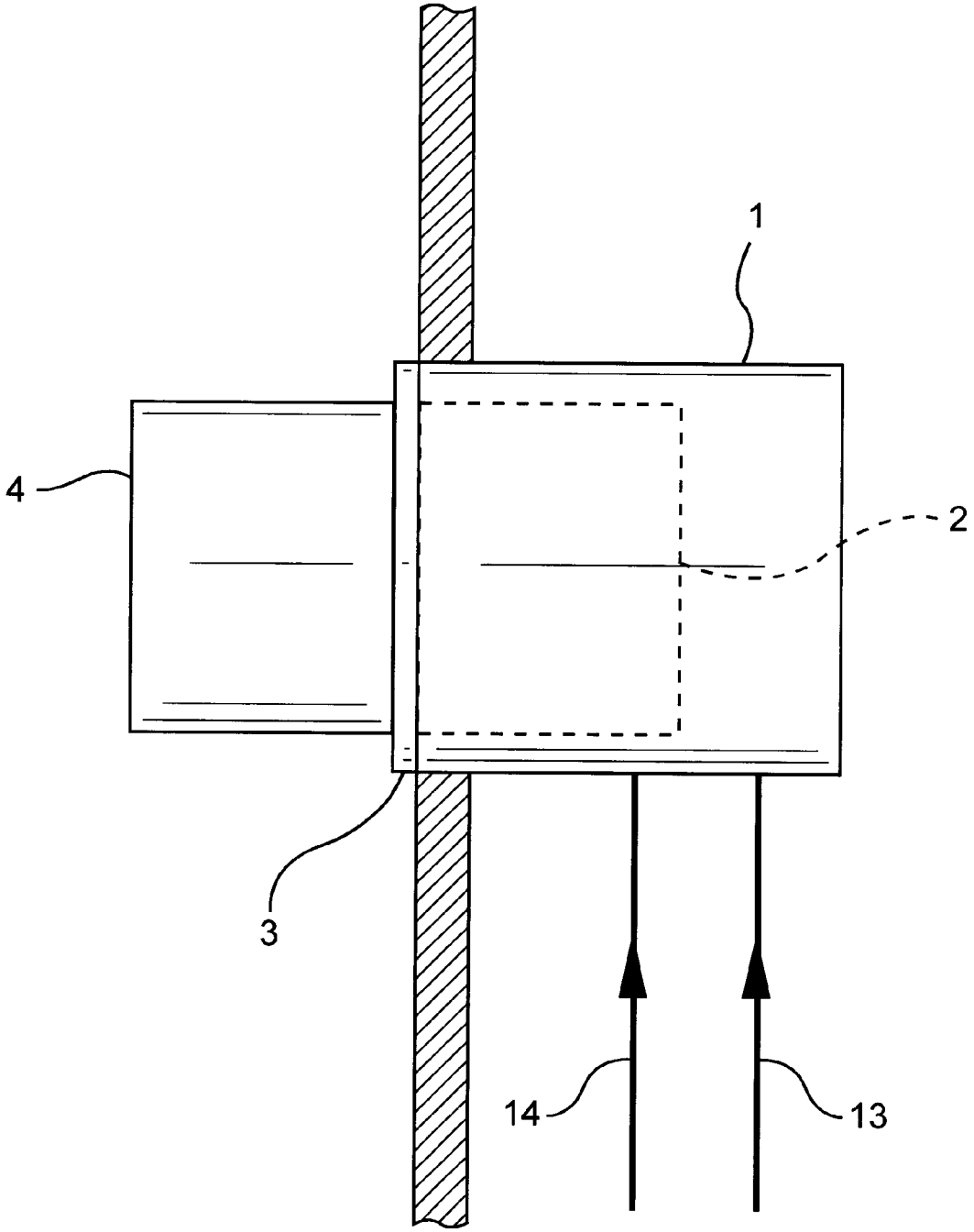
FIG. 1 is a schematic representation of a selected and installed assembly according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

As seen in FIG. 1, the present invention comprises providing a housing body 1, an optional pressure balancing valve 2 disposed inside the housing body, a mounting flange 3 disposed on the housing body, and at least one interchangeable cartridge 4. The cartridge is separable or removable from the mounting flange and valve body.

Figure 2:
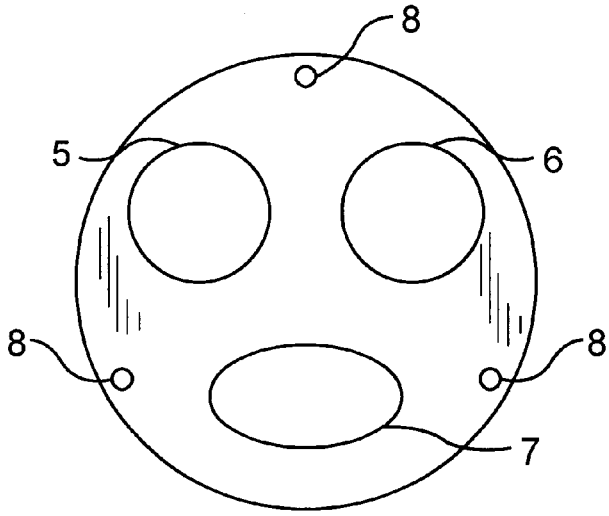
FIG. 2 is a schematic representation of a representative common footprint for a cartridge and mounting flange according to the present invention.

Each interchangeable cartridge has the same footprint, e.g. a cold water inlet 5, a hot water inlet 5, and an outlet 7, and the same mounting means 8, such as openings which accept mounting bolts to attach the cartridge to the mounting flange, as illustrated for example in FIG. 2.

Figure 3:
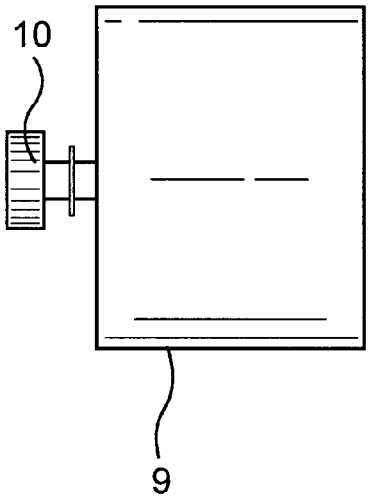
FIG. 3 is a schematic representation of a representative rotatable temperature control valve.
Figure 4:
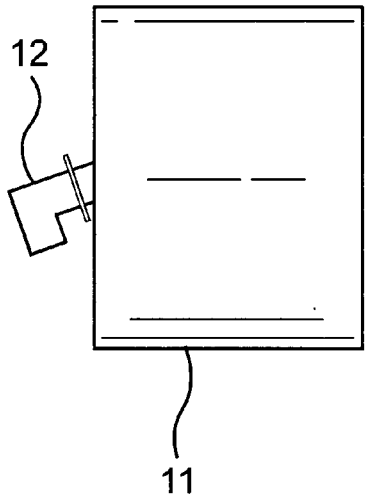
FIG. 4 is a schematic representation of a representative pivotable and rotatable temperature and volume control valve.

The interchangeable cartridge 4 may be of any variety, such as a cycling valve 9 which allows temperature control as shown for example in U.S. Pat. No. 5,562,120, and as illustrated schematically in FIG. 3, or a lever actuated cartridge valve which allows both temperature and volume control of a mixed flow, as shown for example in U.S. Pat. No. 5,794,650, and as illustrated schematically in FIG. 4. That is, the cartridges in a given system might be functionally different yet have the same footprint and mounts. All interchangeable cartridges in a given system according to the present invention have substantially the same depth.

Thus, a system according to the present invention may comprise at least one housing body 1 of a given depth, a mounting flange 3 of a given depth, and at least one cartridge 4 of a given depth. The desirable result is a common roughing in depth for all combinations of housing body, flange and cartridge for a given system according to the present invention. A system according to the present invention may further preferably comprise trim having dimensions concordant with the common underbody system defined by the housing body 1, flange 3 and cartridge 4. The trim may comprise handles 10 and 12, escutcheons, and the like which may be added for functional and/or aesthetic purposes.

Thus, for example, a plumber or builder may install hot and cold water lines, establish the desired location for the installation of a fitting, connect the housing body to the water supply lines 13 and 14 and attach the mounting flange 3 to the housing body. The housing body may also optionally have an integrally formed or pre-attached mounting flange 3. Flexibility is afforded at this point to allow later decisions regarding the desired functionality of the fitting, e.g. temperature control only, or temperature and volume control, by permitting the choice and installation of the cartridge at a later time. Furthermore, decisions regarding choice of trim to be associated with the fitting and the installation of the trim can be deferred. This is accomplished by allowing the plumber to pre-set a common roughing in depth instead of customizing the depth to each variety of valve and/or the desired associated trim. Thus, the consumer can later to decide change or upgrade to a different type of trim without requiring alteration of the plumbing installation point.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A plumbing installation system comprising:

at least one housing body;

a first cartridge which is removably attachable to said housing body;

a second cartridge which is removably attachable to said housing body;

wherein said first and second cartridges are functionally dissimilar and interchangeable; and wherein said first and second cartridges are of substantially similar depth.

2. A method of installing plumbing fittings comprising:

providing at least one housing body;

providing a first cartridge which is removably attachable to said housing body;

providing a second cartridge which is removably attachable to said housing body, wherein said first and second cartridges are functionally dissimilar; and wherein said first and second cartridges are of substantially similar depth;

installing one of said cartridges onto said housing body.

* * * * *